US005178265A

United States Patent [19]

Sepke

[11] Patent Number: 5,178,265

[45] Date of Patent: Jan. 12, 1993

[54] PUSH-PUSH SNAP SWITCH

[75] Inventor: Arnold L. Sepke, Hudson, Ill.

[73] Assignee: White Consolidated Industries, Inc., Cleveland, Ohio

[21] Appl. No.: 650,184

[22] Filed: Feb. 4, 1991

[51] Int. Cl.[5] ..... H01H 19/62

[52] U.S. Cl. ..... 200/528; 200/527; 200/533; 200/574

[58] Field of Search ..... 200/523, 526, 527, 528, 200/530, 573, 574, 416, 417, 242, 533

[56] References Cited

U.S. PATENT DOCUMENTS

| | | | |
|---|---|---|---|
| 3,204,067 | 8/1965 | Brown | 200/527 |
| 3,223,072 | 12/1965 | Bross | 200/526 |
| 3,402,379 | 9/1968 | Amis et al. | 200/526 X |
| 3,523,168 | 8/1970 | Holmes | 200/526 |
| 3,694,603 | 9/1972 | Congelliere et al. | 200/526 |
| 4,175,222 | 11/1979 | Buttner | 200/528 |
| 4,230,921 | 10/1980 | Wearing et al. | 200/526 |
| 4,293,751 | 10/1981 | Van Benthuysen et al. | 200/527 |
| 4,317,015 | 2/1982 | Buttner et al. | 200/526 |
| 4,319,106 | 3/1982 | Armitage | 200/526 |
| 4,463,231 | 7/1984 | Cooper et al. | 200/528 |
| 4,506,124 | 3/1985 | Rose et al. | 200/528 |
| 4,771,141 | 9/1988 | Flumignan et al. | 200/528 |
| 4,891,476 | 1/1990 | Nation et al. | 200/11 R |
| 4,996,401 | 2/1991 | Park | 200/528 X |
| 5,043,546 | 8/1991 | Krause | 200/527 |

*Primary Examiner*—Henry J. Recla
*Assistant Examiner*—Glenn T. Barrett
*Attorney, Agent, or Firm*—Pearne, Gordon, McCoy & Granger

[57] ABSTRACT

An electrical switch which has a body, a contact base at one end of the body, a cam member positioned for rotation within the body, and a plunger positioned within the body for nonrotating movement. The cam member has a conductive bridge contact portion and has cam followers which engage the cam surface in the base to move the cam member between a make position in which the bridge is in contact with contacts on the base and a break position in which the bridge is spaced from the contacts on the base. The plunger has an actuatable pushbutton portion extending from the body and has driving portions which engage driven portions on the cam member to rotate the cam member upon nonrotating movement of the plunger. The plunger engages the cam member to provide a rotating first camming action, while the cam member engages the base to provide a nonrotating second camming action.

19 Claims, 4 Drawing Sheets

PUSH-PUSH SNAP SWITCH

BACKGROUND OF THE INVENTION

1. Field of the Invention

This invention relates to a solid contact electrical switch, and more particularly to a pushbutton operated switch having a rotating member, sometimes referred to as a "ball point pen" type switch.

2. Description of the Prior Art

Various pushbutton operated switches with rotating members have been used for many years and are well known in the art. These switches are characterized by a pushbutton actuator having cam surfaces which engage corresponding cam followers on a rotating intermediate cam member to produce a rotary motion that is used in a switching mechanism. The resulting action is similar to that of a ball point pen, in that sequentially pushing the pushbutton causes engagement of the rotating member to open and close the switch.

Examples of such switches are shown in the following U.S. Pat. No. 3,204,067, issued to Brown; U.S. Pat. No. 3,223,072, issued to Bross; U.S. Pat. No. 3,402,379, issued to Amis et al.; U.S. Pat. No. 3,523,168, issued to Holmes; U.S. Pat. No. 3,694,603, issued to Congelliere et al.; U.S. Pat. No. 4,175,222, issued to Buttner; U.S. Pat. No. 4,230,921, issued to Wearing et al.; U.S. Pat. No. 4,293,751, issued to Van Benthuysen et al.; U.S. Pat. No. 4,317,015, issued to Buttner et al.; U.S. Pat. No. 4,319,106, issued to Armitage; U.S. Pat. No. 4,463,231, issued to Cooper et al.; U.S. Pat. No. 4,506,124, issued to Rose et al.; U.S. Pat. No. 4,771,141, issued to Flumignan et al.; and U.S. Pat. No. 4,891,476, issued to Nation et al.

These switches employ various designs to utilize the rotational movement of the intermediate rotating cam member to make and brake the contacts. For example, in U.S. Pat. No. 3,204,067, issued to Brown, the conductor which rotates with the cam member rotationally engages fixed contacts mounted in the base. In U.S. Pat. No. 3,523,168, issued to Holmes, the rotating cam member moves a second plunger to accomplish the switching. In U.S. Pat. No. 4,175,222, issued to Buttner, and U.S. Pat. No. 4,317,015, issued to Buttner et al., the rotation of the cam member moves a cylindrical contact member downwardly to move it out of engagement with the fixed contacts. In U.S. Pat. No. 4,293,751, issued to Van Benthuysen et al., the cam member has a drive arm with contactor paddles which rotate with the cam member, and as the arm member rotates, the paddles engage a contact plate fixed in the housing.

In many cases, these types of switches are unsuitable for certain applications due to the manner in which the conductor engages and disengages from the contacts. To produce a more desirable switching action, many switches require multiple springs or complicated mechanisms to enhance the engagement of the bridge conductor with the contacts and to move the conductor away from the contacts so as to reduce heat and erosion as much as possible. Furthermore, these switches should compensate for contact "bounce" which may occur when the contacts move together rapidly.

SUMMARY OF THE INVENTION

The present invention provides an improved electrical contact switch which overcomes the disadvantages and shortcomings of the prior art. The switch of the present invention provides superior switching action with a minimum of parts and is easily assembled.

The switch accomplishes many of its objectives by using a double camming design in which a first camming action is provided by the engagement of the pushbutton actuator or plunger with the intermediate camming member and a second camming action is provided by the engagement of the camming member with a cam surface on the contact base pad to move the cam member and a bridge contact assembly attached thereto into contact with the base.

The switch of the present invention incorporates a double break action. This double break action provides the capability of interrupting higher electrical loads over a longer life cycle. The switch breaks the circuit at two points simultaneously, so that the contact gap opens twice as fast, reducing the arc duration, contact surface temperature and material erosion, and resulting in a longer life for the contacts in heavier electrical switching applications.

To compensate for and reduce contact "bounce," the switch of the present invention includes a "shock absorber" feature in which the bridge contact assembly is attached to the intermediate rotating cam member through an attachment means that allows the bridge to have limited resilient axial movement relative to the cam member so that the bridge can absorb some of the shock associated with the axial movement of the cam member toward the contacts. This resilient movement substantially reduces contact bounce which would otherwise adversely affect the life of the contact surfaces and thus would reduce the useful life of the switch.

This shock absorber effect is accomplished by providing a bridge in the form of a U-shaped member having a pair of spring arms that are biased towards each other. The bridge contact assembly is inserted around a portion of the camming member, and the camming member is tapered so that the radial inward bias of the spring arms urges the U-shaped bridge away from the camming member and toward the contacts ont eh base pad. When the switch closes and the contact bridge assembly hits the contacts, the bridge is pushed toward the camming member in opposition to the spring force produced by the U-shaped bridge and the tapered cam member, absorbing some of the shock produced by the closing of the switch.

An additional shock absorber effect is created through the use of air trapped within the switch as the switch is actuated. As the nonrotating plunger engages the rotating cam member to rotate it, some air is trapped in an enclosed space between the plunger and the cam member. The switch of the present invention includes a small air escape hole to permit the air to escape. This air escape hole is sized to restrict the flow of air, creating the effect of an air shock absorber which helps to reduce and control the speed of descent of the cam member as it moves toward the base pad, and which helps to further minimize any bounce that might occur as the contacts close. The forcing of air through the hole also acts to dislodge dust and dirt that might accumulate in the chamber occupied by the contacts and bridge.

The switch of the present invention also incorporates a contact wiping feature in which the conductive bridge, which is attached to rotate with the cam member, rotates through a portion of its arc length before lifting away from the fixed contacts during the "break" cycle, and again rotates through a portion of its arc length after re-engaging the contacts during the "make"

cycle. By providing lateral travel of the movable bridge over fixed contacts while pressure between contacts exists, a wiping movement is created which cleans contamination during each actuation and promotes a better electrical contact by lowering electrical resistance in the circuit.

The switch of the present invention is designed for rapid assembly that would be ideally suited to automated manufacturing techniques, since all components are inserted into the switch body from one end. Because the interior of the switch body has a hexagonal configuration, all components are designed to become properly registered upon assembly by conforming to this hexagonal configuration.

These and other advantages are achieved by the present invention of an electrical switch which comprises a body and a base at one end of the body. The base has electrical contacts on one side and has a peripheral cam surface. A cam member is positioned for rotation within the body. The cam member has a conductive bridge contact portion and has cam followers which engage the cam surface in the base to move the cam member between a make position in which the bridge contact portion is in contact with the contacts on the base and a break position in which the bridge contact portion is spaced from the contacts on the base. The cam member also has driven portions. A plunger is positioned within the body for non-rotating movement. The plunger has an actuatable pushbutton portion extending from the body. The plunger has driving portions which engage the driven portions on the cam member to rotate the cam member upon the nonrotating movement of the plunger. The plunger engages the cam member to provide a first camming action causing the cam member to rotate, while the cam member rotates relative to the base and engages the base to provide a second camming action.

DETAILED DESCRIPTION OF THE PREFERRED EMBODIMENT

Figure 1:
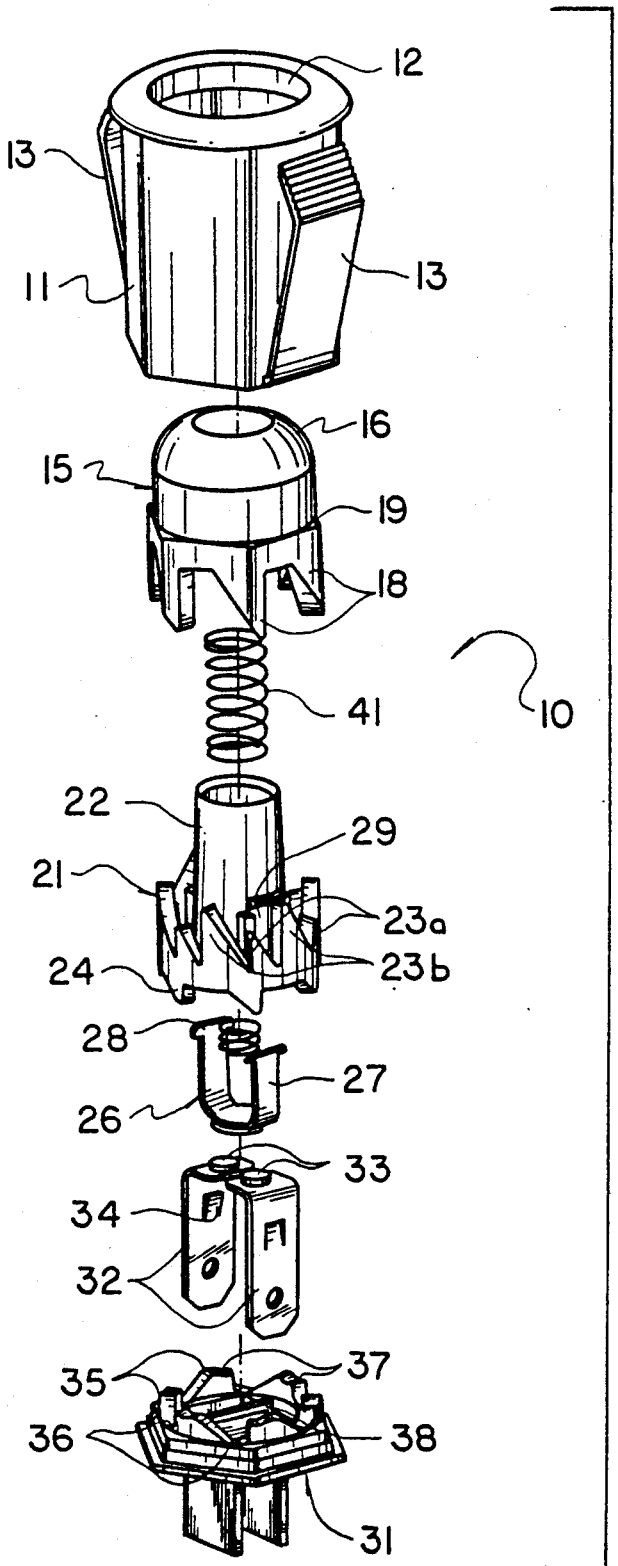
FIG. 1 is a perspective exploded view of the switch of the present invention.
Figure 2:
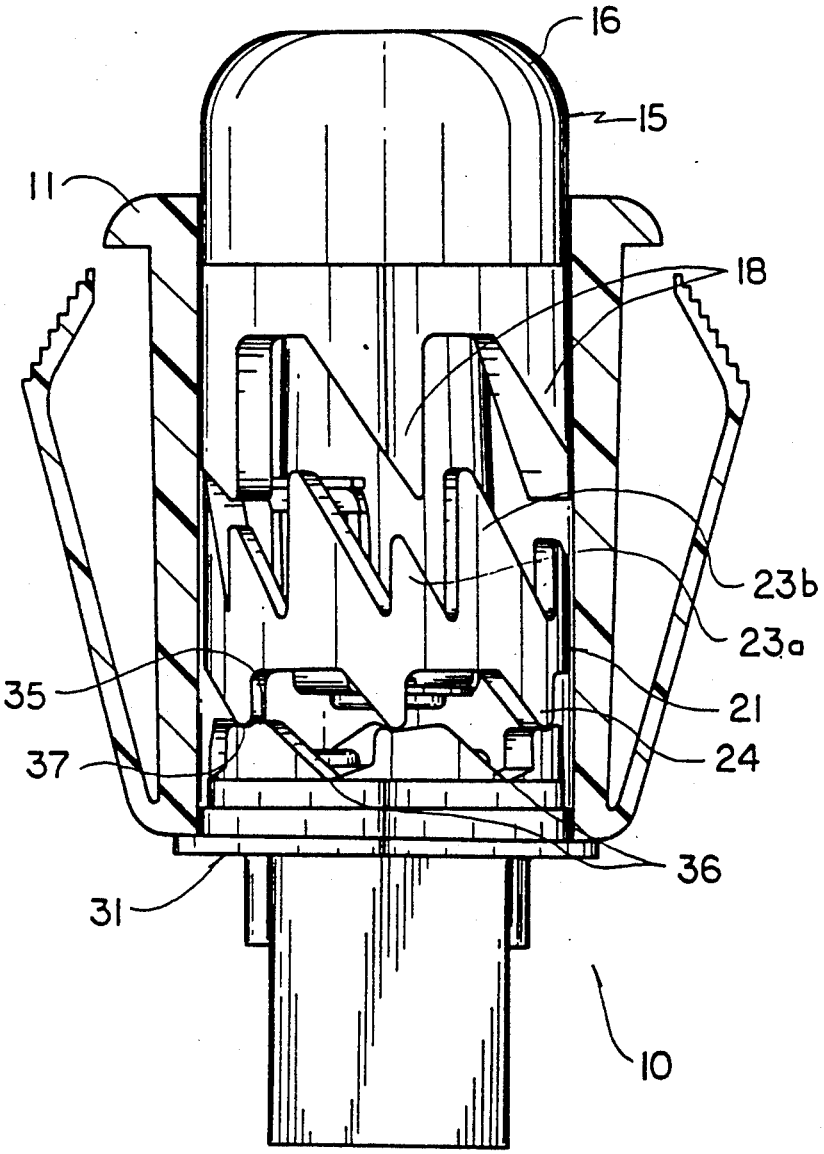
FIG. 2 is a side sectional view of the switch of FIG. 1 after assembly with the switch in the "off" or "break" position.
Figure 3:
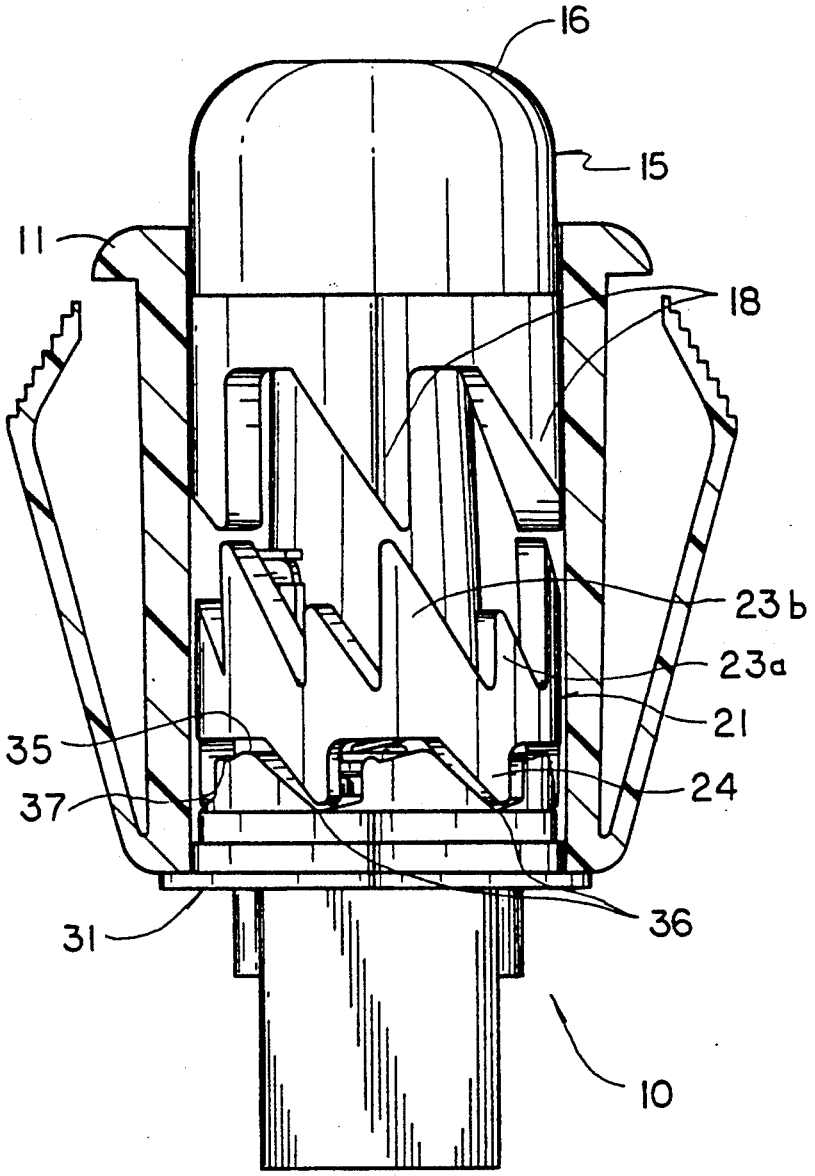
FIG. 3 is a side sectional view, similar to FIG. 2, showing the switch in the "on" or "make" position.

Referring more particularly to the drawings and initially to FIGS. 1, 2 and 3, there is shown a switch 10 in accordance with the present invention.

The elements of the switch 10 are contained in a housing or body 11 which is made of any suitable material, such as plastic. The body 11 has a hollow interior and a central circular opening 12 at one end. The body 11 has a generally hexagonal external configuration, and the hollow interior of the body also has a hexagonal cross section.

The hexagonal external configuration of the body 11 prevents the body from turning after the switch has been installed in a corresponding hexagonally shaped mounting hole. By preventing the switch from rotating, problems resulting from the twisting of wires are avoided, and the potential for wear at the junction of the switch body 11 and the edge of the mounting hole is reduced.

The switch body 11 includes a pair of spring arms 13, one on each side of the body. Each arm 13 is integrally molded with the body 11 and includes serrations on the end of the arm. The arms 13 hold the switch body 11 in place in the mounting hole.

Extending from the opening 12 in the top of the body 11 is a plunger 15. The plunger 15 is made of any suitable material, such as plastic. The plunger 15 has a pushbutton portion in the form of a relatively large radius, spherically shaped, actuating surface 16 at one end. The actuating surface 16 is capable of extending through the close-fitting circular opening 12 in the body to permit the switch to be actuated by pushing the plunger 15 into the body 11. The outside diameter of the actuating surface 16 is about equal to the distance between the flats on hexagonally shaped interior of the body 11. The curvature and relatively large radius of the actuating surface 16 help to deflect lateral impacts to the actuating surface, thus helping to prevent damage to the switch. In the center of the actuating surface 16 is a tubular portion 17 (FIG. 4) formed in the interior of the plunger 15. Inside the tubular portion 17 are ribs 20 which extend beyond the tubular portion.

At the end of the plunger 15 opposite the actuating surface 16 are driving portions in the form of a plurality of protruding wedge-shaped camming teeth 18 which provide part of the first camming action of the switch. The plunger 15 is hexagonal in cross section at the location of the teeth 18, permitting the plunger to move axially within the hexagonally shaped interior of the body 11, while preventing the plunger 15 from rotating therein. In the preferred embodiment of the invention shown in the drawings, six teeth 18 are provided, matching the six sides of the hexagonal shape. It should be understood that more or fewer teeth 18 can be provided as desired.

The plunger 15 also has a ledge 19 which is formed at the junction of the actuating surface 16 and the hexagonal shaped portion that form the teeth 18. The ledge 19 separates the actuating surface 16 and the teeth 18 and is larger in dimension than the opening 12 in the body, preventing the plunger 15 from escaping from the body 11 through the opening, and limiting the axial travel of the plunger 15 to a predetermined outward position defined by the interior shoulder around the opening 12 in the body 11.

The plunger 15 engages an intermediate rotating cam member 21. The cam member 21 may be made of any suitable material that is preferably nonconducting, such as plastic. The cam member 21 includes a cylindrical barrel 22 which extends toward and surrounds the corresponding central tubular portion 17 (FIG. 4) formed in the interior of the plunger 15. Positioned around the barrel 22 are driven portions in the form of a plurality of camming teeth 23 which extend toward the plunger 15 and engage the corresponding teeth 18 on the plunger to provide the first camming action of the switch. As shown in the preferred embodiment of the invention, a total of 12 teeth 23 are provided, six small teeth **23*a* and six large teeth 23*b* arranged in an alternating fashion. In accordance with the preferred embodiment, the number of small teeth 23*a* and the number of large teeth 23*b* each matches the number of teeth 18 provided on the plunger 15, so that the total number of teeth 23 on the cam member 21 is twice the number of teeth 18** on the plunger. However, the number of teeth is not critical to the invention as long as proper spacing is achieved. Any suitable number of teeth may be employed as long as the plunger drives the cam member the required angular distance to cause the first camming action of the switch elements. The radial relationship of the helically configured cam teeth must be maintained in order to achieve the operation of the switch.

The teeth 18 on the plunger 15 and the teeth 23 on the cam member 21 each have a sawtooth shape or wedge shape with a diagonal slanting portion on one side of each tooth which forms a helical configuration when applied to the circular configuration of the switch. The helically configured portion provides a first camming action and permits the nonrotating plunger 15 to propel the cam member 21 when the plunger moves axially and the teeth 18 engage the teeth 23.

The cam member 21 at the location of the teeth 23 is generally circular in cross section, to allow the cam member to rotate. The round cam member 21 rotates within the body 11 which has a hexagonally shaped interior, so that the cam member is retained in position by engagement with the hexagonal flat surfaces of the interior of the body 11. This provides minimum surface contact and thus reduces rotational friction. In addition, the line contact between the cam member 21 and the interior of the body 11 tends to be self cleaning at the contact surfaces between the round cam member and the flat interior surfaces of the body.

The cam member 21 also has cam followers in the form of a plurality of protruding camming feet 24 that extend from the cam member in the opposite direction from the teeth 23. The feet 24 provide part of a second camming action to open and close the switch. Six feet 24 are shown in the preferred embodiment the invention in the drawings, and the number of feet 24 matches the number of teeth 18 on the plunger 15. However, as previously stated, the number of teeth is not critical to the invention. Any suitable number of teeth may be employed as long as the cam member is driven the necessary angular distance to cause the second camming action.

A bridge is attached to the end of the rotating cam member 21. In the embodiment shown in the drawings, the bridge is integrally formed with a contact 25 to form a bridge contact assembly 26, and the bridge contact assembly is entirely formed of metal or other electrically conducting material. Alternatively, the bridge and the contact may be separately formed, with the bridge formed of any suitable material and the contact formed of metal or other electrically conducting material, and with the conductive contact attached at the outwardly extending portion of the bridge, such as by riveting or welding the contact in place.

Figure 4:
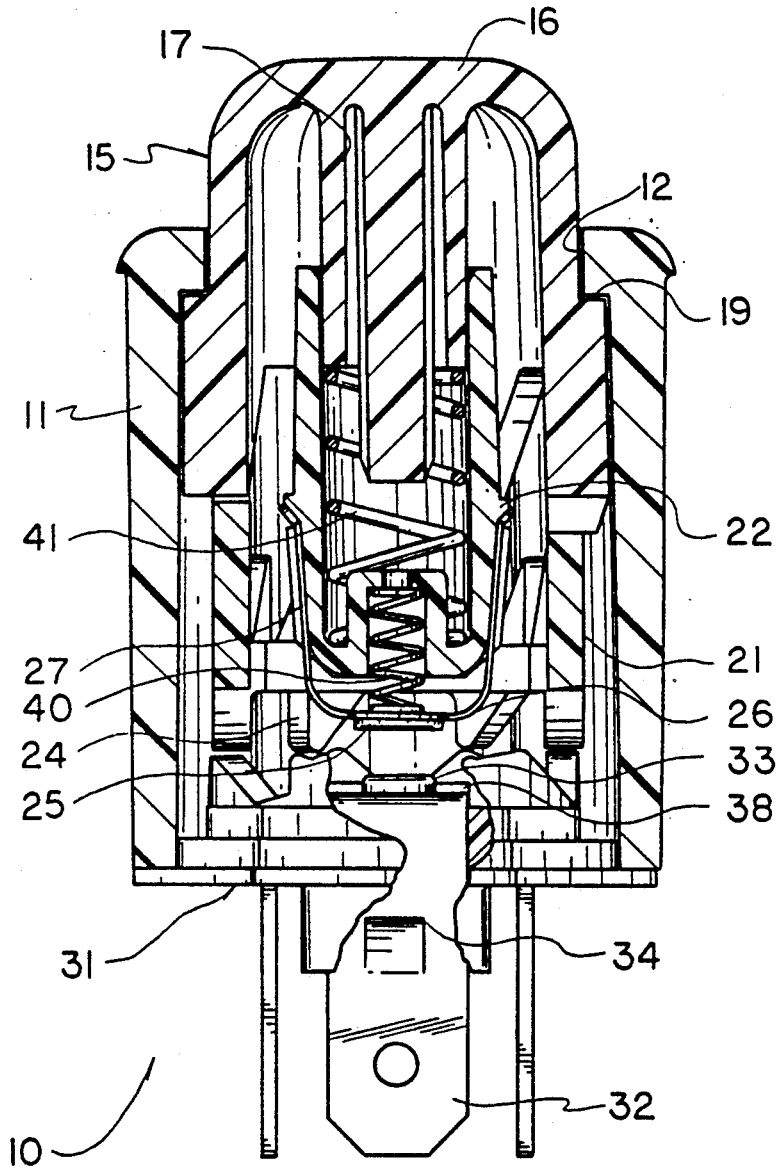
FIG. 4 is a side cross-sectional view, similar to FIGS. 2 and 3, showing the interior of the switch elements.

The bridge contact assembly 26 is inserted into the end of the cam member 21 by means of a pair of spring arms 27, each having a lock tab 28 on the end thereof. The spring arms 27 are spring loaded to be biased toward each other. When the bridge contact assembly 26 is inserted into place around the end of the cam member 21, the spring arms 27 are inserted between corresponding guide ribs 29 on each side of the cam member. The spring action of the arms 27 is spread against the bias tension when the spring arms are inserted between the guide ribs, and the lock tabs 28 snap over the ends of the guide ribs 29 to prevent the bridge contact assembly 26 from coming off the cam member. The bridge contact assembly 26 is capable of limited axial movement between the ribs 29 with respect to the cam member 21, so that the bridge contact assembly 26 must follow the rotational movement of the cam member. As shown in FIG. 4, the portion of the cam member 21 contacted by the bridge contact assembly 26 is tapered to urge the bridge contact assembly 26 away from the cam member 21 by a limited distance as the spring arms 27 exert radial inward force. This action is further enhanced by transverse ribs 30 which extend between the guide ribs 29 at the end of the guide ribs. The lock tabs 28 on the ends of the spring arms 27 are forced over the ribs 30 to spread the spring arms further apart. The spread of the spring arms 27 creates a preload force against the sides of the cam member 21. The taper of the sides of the cam member 21 and the presence of the ribs 30 induces a motion of the bridge contact assembly 26 away from the end of the cam member by a predetermined amount. This bias helps to maintain a firm contact between the bridge contact assembly 26 and the switch contacts 33 and compensates for standard manufacturing tolerance variations by virtue of the semi-floating arrangement of the bridge. In addition, the spring-like bias reduces contact "bounce," acting somewhat like a shock absorber, as will be explained more fully below. The action of this bias may be enhanced by providing a spring 40 between the bridge contact assembly 26 and the end of the cam member 21 as shown in FIGS. 1 and 4.

A contact base pad 31 closes the end of the body 11 opposite the opening 12. The base pad 31 has a generally hexagonal outer periphery that matches the end of the body 11. The hexagonal outer side wall of the base pad 31 engages the end of the body 11 and may be bonded or fused to the body by ultrasonic or other means.

A pair of contact brackets 32 are inserted into the base pad 31. Each bracket 32 is made of metal or other electrically conductive material and provides one of the switch contacts 33. Each bracket 32 has a snap lock retainer 34 on one side that engages the base pad 31 and prevents the bracket from coming out of the base pad after it has been assembled.

Around the center of the base pad 31 is a peripheral cam surface having a plurality of alternating camming surface portions comprising raised platforms 35 separated by valleys 36. The platforms 35 and the valleys 36 engage the protruding feet 24 on the end of the cam member 21 as the cam member rotates relative to the base pad 31 to produce the second camming action. When the feet 24 on the cam member are located in engagement with the valleys 36, the contact 25 on the bridge contact assembly 26 on the end of the cam member 21 comes into electrical contact with the contacts 33, closing the circuit. When the feet 24 on the cam member 21 are located on the platforms 35, the bridge contact assembly 26 is spaced from the contacts 33, creating an open circuit. To assist in positioning the feet 24 on the platforms 35, each platform 35 has a small depression 37 formed therein. As shown in the preferred embodiment in the drawings, the number of valleys 36 and the number of platforms 35 is the same as the number of feet 24 protruding from the cam member 21, and six valleys 36 and six platforms 35 are shown. The number of valleys and platforms, however, is not critical to the invention as long as the proper angle spacing the elements is maintained.

The center of the base pad 31 includes an insulating wall 38 that provides for separation of the contact brackets 32. Laterally extending flanges 39 are also provided on the opposite side of the base pad 31 to protect the outwardly extending ends of the brackets 32 and the wires or terminals connected to the brackets. Quick connect press-on terminals are preferably connected to the ends of the brackets 32 to permit fast assembly of the switch. Solder connections may also be used. The base pad 31, including the wall 38 and the flanges 39, may be made of any suitable nonconducting material, such as plastic.

A coil spring 41 is located between the cam member 21 and the plunger 15 and provides pre-load separation between the plunger and the rotating cam member. The spring 41 acts to propel the rotating cam member 21 to the position closest to the contact base pad 31 permitted by the platforms 35 and valleys 36 pattern on the base pad. The spring 41 also produces a biasing force to urge the rotating cam member 21 into continual engagement with the base pad 31 to prevent unintentional indexing of the position of the switch due to vibration or impact.

As shown in FIG. 4, the coil spring 41 has an outside diameter slightly less than the inside diameter of the hollow barrel 22. The spring 41 resides within the barrel 22 with the outer perimeter of the coil spring supported by the interior walls of the barrel. The spring 41 is retained by the base of the hollow barrel 22. The cylindrical center extending tubular portion 17 of the plunger 15 has an outside diameter about equal to that of the spring 41, and thus slightly less than the inside diameter of the hollow barrel 22, with the ribs 20 fitting inside the spring 41. The wall thickness of the tubular portion 17 of the plunger is at least as thick as the wire diameter of the spring 41. For this reason, when the plunger 15 is depressed, the spring 41 is compressed. When pressure is released, the coil spring 41 returns the plunger 15 to its extended position with the actuating surface 16 extending through the opening 12. The ribs 20 provide a mounting post onto which the spring 41 is fitted during assembly.

An air escape hole 44 (FIG. 4) is provided through the end of the barrel 22 of the cam member. The hole 44 allows the escape of air trapped within the tubular portion 17 and the barrel 22 when these elements telescope together when the plunger 15 is actuated. As will be explained in more detail below, the hole 44 is sized to produce a secondary shock absorber effect when the switch is actuated.

Assembly

The assembly of the switch of the present invention can be understood with reference to FIG. 1. The switch 10 is designed for rapid assembly that would be ideally suited to automated means. All components are inserted into the switch body 11 from one end and the hexagonal configuration of the interior of the body assures that all components will become properly registered upon assembly by conforming to the hexagonal configuration.

The plunger 15 is first inserted through the open bottom of the body so that the actuating surface 16 protrudes through the opening 12. Next, the coil spring 41 is inserted into the barrel 22 of the cam member 21, and the bridge contact assembly 26 is snapped into position on the other end of the cam member by inserting the spring arms 27 between the corresponding guide ribs 29 on the cam member until the lock tabs 28 snap into position over the ends of the guide ribs. Then, the cam member 21 is inserted into the body 11 with the barrel 22 on the end of the cam member extending into the corresponding tubular portion 17 on the interior of the plunger 15, and the coil spring 41 fitting onto the ribs 20.

The two metal contact brackets 32 are inserted into the contact base pad 31 and snapped into place by the snap lock retainers 34 engaging the base pad, and the base pad is placed in position at the open end of the switch body 11. The base pad 31 is then preferably fused to the switch body 11 by ultrasonic welding so that the base and the body comprise a unitary structure and so that body is sealed to prevent the entry of dirt.

The switch 10 is now complete and can be easily installed in its final application by a simple press-in operation with the spring arms 13 holding the switch in place in a corresponding hexagonally shaped mounting hole.

Operation

The operation of the switch of the present invention can be described beginning with the switch in the "off" position as shown in FIG. 2. When the switch is in the "off" position, the feet 24 on the cam member 21 rest on the small depressions 37 in the platforms 35 of the base pad 31 so that the bridge contact assembly 26 on the cam member 21 is spaced from the contacts 33 on the base pad 31 and the ends of the teeth 18 on the plunger 15 are adjacent to the ends of the small teeth **23*a* on the cam member 21**.

To turn the switch "on," the user depresses the plunger 15 to push the plunger through the opening 12 and into the body 11. The plunger 15 moves axially, but is restrained from rotating by its engagement with the hexagonally shaped interior of the body 11. The axial movement of the plunger 15 causes the plunger to move toward the cam member 21 against the action of the coil spring 41 and causes the teeth 18 on the plunger to move into engagement with the teeth **23*a* on the cam member 21. When the helically configured portions of the teeth 23*a* and 18 engage, this causes the cam member 21 to be propelled to rotate by a predetermined angular amount within the body 11. In the preferred form of the invention shown in the drawings in which the plunger has six teeth 18 and in which the cam member 21 has six small teeth 23*a* and six large teeth 23*b* and in which the base pad 31 has six platforms 35 and six valleys 36, the cam member 21 rotates approximately 60°, so that six complete on/off cycles can be obtained during one complete revolution of the rotating cam member 21. This rotation of the cam member 21 causes the feet 24 on the cam member 21 to move off the platforms 35 on the base pad 31 and into the valleys 36. The rotating cam member 21 is urged into contact with the base pad 31 by the coil spring 41. With the feet 24 in the valleys 36, the bridge contact assembly 26 comes into contact with both contacts 33**, to complete the circuit so that the switch is turned "on."

With the switch in the "on" position as shown in FIG. 3, the feet 24 on the cam member 21 rest in the valleys 36 of the base pad 31, and the ends of the teeth 18 on the plunger 15 are adjacent to the ends of the large teeth **23*b* on the cam member 21**.

To turn the switch "off," the user again depresses the plunger 15 to push the plunger through the opening 12 into the body 11. The axial movement of the plunger 15 causes the plunger to move toward the cam member 21 against the action of the coil spring 41 and causes the teeth 18 on the plunger to move into engagement with the teeth on the cam member 21. This time, the plunger teeth engage the large teeth **23*b* on the cam member 21**.

When the helically configured portions of the teeth 18 and 23b engage, the cam member 21 is propelled to rotate by the predetermined angular amount, i.e., approximately 60°, within the body 11. This rotation of the cam member 21 causes the feet 24 of the cam member to be pushed out of the valleys 36 on the base pad 31 and up onto the platforms 35 against the force of the coil spring 41. With the feet 24 urged into the depressions on the platforms 35 by the action of the spring 41, the switch comes to rest with the bridge contact assembly 26 spaced from the contacts 33 as shown in FIG. 2, and the switch is turned "off."

To minimize electrical erosion of contact surfaces, the contacts should close quickly. However, the effects of point "bounce" should also be taken into consideration. When hard contacts come together rapidly, they tend to rebound. Total transfer time of the closing cycle consists of the time for the contacts to close plus the time that bounce occurs. In anticipation of this effect, the cam profile of the platforms 35 and the valleys 36 on the base pad 31 may be established to optimize the electrical requirements and work as a system with the other elements contained in the assembly.

The switch of the present invention compensates for the effects of "bounce" by the manner in which the conductive bridge contact assembly 26 is mounted to the cam member 21. The "U" configuration of the spring arms 27 of the bridge contact assembly 26 have an inward spring bias which tends to urge the arms together. Each of the spring arms 27 is mounted around the portion of the cam member 21 which is tapered to produce a semi-V shape, as shown in FIG. 4. When the switch is in the "open" position, the spring arms 27 are urged to the narrower end of the cam member 21 due to the spring action of the arms 27 that tend to urge the arms together. The axial movement of the bridge contact assembly 26 away from the cam member 21 is limited by the engagement of the lock tabs 28 on the ends of the guide ribs 29. By allowing the bridge contact assembly 26 to have a limited amount of axial movement with respect to the cam member 21, the spring force of the inwardly biased spring arms 27, which are forced apart due to the positioning of the arms around the cam member, creates a shock absorber effect when forced to expand as the widening "V" causes increasing resistance to the inward bias of the two arms of the bridge. This shock absorber effect acts to minimize bounce as well as to provide for self-alignment between the bridge contact assembly 26 and the contacts 33.

The spring force that results from the relationship between the U-shaped bridge contact assembly 26 with the spring arms 27 and the tapered end of the cam member 21 along with the ribs 30 is calculated to provide a force or pressure between the bridge contact assembly and contacts 33. By increasing the force between closed contact surfaces, the electrical resistance is lowered, and thus the build-up of heat is reduced. With the proper pressure between the contact surfaces, the balance between electrical and mechanical erosion of contact surfaces can be optimized. In so doing, any surface films that form on the contact surfaces can be successfully broken through, and electrical conductivity can be maintained when used in applications of severe vibration.

During the "break" sequence of actuation, a desirable condition of a slower, more gradual separation of the movable bridge contact assembly 26 and stationary contacts 33 is achieved. As the plunger 15 is depressed, its hexagonal shape prevents the plunger from turning, while the first camming action of interlocking teeth 18 and 23 causes the cam member 21 to rotate. This rotational motion transfers to the bridge contact assembly 26, which is rotationally immobile with respect to the cam member 21 and thus is dependent exclusively upon movement from the cam member for its radial positioning. The bridge contact assembly 26 rotates through a portion of its angular movement before lifting away from the contacts 33 as the cam member 21 rides upward on the ramp incline to the platform 35 of the base pad 31. The bridge contact assembly 26 also rotates through a portion of its angular movement after dropping back onto the contacts 33 as the cam member 21 rides downward on the ramp incline to the valley 36 on the base pad 31. This rotational movement of the bridge contact assembly 26 is carefully planned to provide lateral travel of movable bridge contact assembly over the fixed contacts 33 while pressure between the bridge contact assembly and the contacts exists. This wiping movement cleans contamination during each actuation and promotes a better switch contact-to-contact relationship and improved action by lowering electrical resistance in the circuit.

The relationship between the central cylindrical tubular portion 17 of the plunger 15, coil compression return spring 41 and center cylindrical extension or barrel 22 on the end of the cam member 21 also provides a "shock absorber" effect. As discussed above, the coil spring 41 has an outside diameter slightly less than the inside diameter of the hollow barrel 22. The spring 31 is inserted and resides within the barrel 22. When the plunger 15 is depressed, the spring 41 is compressed. When pressure is released, the coil spring 41 returns the plunger 15 to its extended position.

Because the tubular portion 17 of the plunger is closed at its inward end and fits closely within the corresponding tubular barrel 22, when the plunger 15 is depressed and the barrel and the tubular portion telescope together, a reduction in the volume contained within these two tubular forms results. This volumetric reduction would otherwise produce a build-up of air pressure between the two parts and would hamper the action of the switch 10. To remedy to this undesirable situation, the air escape hole 44 (FIG. 4) is molded into the central portion of the closed end of the barrel 22 of the cam member.

The hole 44 is of a size that allow a semi-restriction of air during compression and expansion of these two telescoping members. The assembly acts much like an air shock absorber, helping to reduce and control the speed of descent of the cam member 21 when it is indexed and falls from the platform 35 on the base pad 31. In this way, it contributes and works in concert with the U-shaped bridge contact assembly 26 in helping to minimize any bounce that might occur as the contacts close. The forcing of air created by this action also acts to dislodge dust and dirt that might accumulate in the chamber occupied by the contacts 33 and bridge contact assembly 26.

The switch 10 of the present invention also incorporates a double break action. Double break action switches, which are capable of interrupting higher electrical loads over a longer life cycle, break the circuit at two points simultaneously. In effect, the gap between contact surfaces from an electrical perspective opens twice as fast, reducing the arc duration, contact surface temperature and material erosion. The overall result is a longer electrical life of the contact surfaces providing for heavier electrical switching requirements.

While the invention has been shown and described with respect to a particular embodiment thereof, this is for the purpose of illustration rather than limitation, and other variations and modifications of the specific embodiment herein shown and described will be apparent to those skilled in the art, all within the intended spirit and scope of the invention. Accordingly, the patent is not to be limited in scope and effect to the specific embodiment herein shown and described nor in any other way this is inconsistent with the extent to which the progress in the art has been advanced by the invention.

What is claimed is:

1. An electrical switch comprising:

a body having means to define a space within the body;

a base at an end of the body, the base having electrical contacts, the base having a peripheral cam surface, and the base being stationary relative to the body;

a cam member positioned for rotation within the body, the cam member having a conductive bridge contact portion and having cam followers which engage the cam surface in the base to move the cam member between a make position in which the bridge contact portion is in contact with the contacts on the base and a break position in which the bridge contact portion is spaced from the contacts on the base, the cam member also having driven portions; and a plunger positioned within the space in the body for nonrotating movement relative to the body, the plunger having an actuatable pushbutton portion extending from the body, the plunger having driving portions which engage the driven portions on the cam member to rotate the cam member upon the nonrotating movement of the plunger, the plunger engaging the cam member to provide a first camming action causing the cam member to rotate, the cam member rotating relative to the base and engaging the base to provide a second camming action.

2. An electrical switch as defined in claim 1, comprising in addition means for biasing the plunger away from the cam member and for urging the cam member toward the base.

3. An electrical switch as defined in claim 1, wherein the bridge contact portion is movably attached to the cam member to allow the bridge contact portion to absorb shock as the cam member engages the base and the bridge contact portion meets the contacts.

4. An electrical switch as defined in claim 1, wherein the body has flat surfaces which engage corresponding flat surfaces on the plunger to prevent the plunger from rotating.

5. An electrical switch comprising:

a hollow tubular body having first and second open ends;

a base enclosing the first open end of the tubular body, the base having electrical contacts on a side toward the body, the base having a peripheral cam surface and the base being stationary relative to the body;

an intermediate cam member positioned for rotation within the body, the rotating cam member having a conductive bridge contact portion and having cam followers which engage the cam surface in the base to move the cam member axially as the cam member is indexed through a predetermined angular movement between a make position in which the bridge contact portion is in contact with the contacts on the base and a break position in which the bridge contact portion is axially spaced from the contacts on the base, the cam member rotating relative to the base and engaging the base to provide an axial camming movement, the cam member also having driven portions;

a nonrotating plunger positioned within the body for axial movement, the plunger having an actuatable pushbutton portion extending from the second open end of the body, the plunger having driving portions which engage the driven portions on the cam member to rotate the cam member upon axial movement of the plunger and to index the cam member through a predetermined angular movement, the plunger engaging the cam member to provide a rotating camming movement; and means for biasing the plunger away from the cam member and for urging the cam member toward the base.

6. An electrical switch as defined in claim 5, wherein the bridge contact portion is resiliently attached to the cam member to allow the bridge contact portion to absorb shock as the cam member engages the base and the bridge meets the contacts.

7. An electrical switch as defined in claim 6, wherein the bridge contact portion is generally U shaped with spring arms that are biased inwardly, and the cam member has a tapered portion that corresponds to the spring arms and around which the spring arms are inserted to resiliently attach the bridge contact portion to the cam member.

8. An electrical switch as defined in claim 5, comprising in addition venting means for allowing the escape of air trapped between the plunger and the cam member when the plunger is actuated.

9. An electrical switch as defined in claim 8, wherein the venting means restricts the flow of air therethrough so that air pressure between the plunger and the cam member increases to control the action of the cam member.

10. An electrical switch as defined in claim 5, wherein the body has flat surfaces which engage corresponding flat surfaces on the plunger to prevent the plunger from rotating.

11. An electrical switch as defined in claim 5, wherein the contacts are on brackets which are rigidly attahed to the base, and the base includes an insulating wall which separates the brackets.

12. An electrical switch as defined in claim 5, wherein the cam member with the bridge contact portion attached thereto rotates while in contact with the contacts on the base before moving to its break position to produce a wiping action.

13. An electrical switch as defined in claim 5, wherein the biasing means is partially contained within a barrel portion of the cam member which extends from one end of the cam member toward the plunger.

14. An electrical switch as defined in claim 5, wherein the body has flat interior surfaces which engage corresponding flat surfaces on the plunger to prevent the plunger from rotating.

15. An electrical switch as defined in claim 14, wherein the body has six flat interior surfaces arranged in a generally hexagonal shape and the plunger has a generally hexagonally shaped exterior.

16. An electrical switch as defined in claim 15, wherein the driving portions on the plunger comprise six teeth each having helically configured portions.

17. An electrical switch as defined in claim 16, wherein the driven portions on the cam member comprise teeth adapted to be engaged by the driving portions to rotate the cam member.

18. An electrical switch as defined in claim 17, wherein the driven portions comprise six first teeth to be engaged by the driving portions to move the switch from the break position to the make position and six second teeth to be engaged by the driving portions to move the switch from the make position to the break position.

19. An electrical switch as defined in claim 18, wherein the first teeth are larger than the second teeth.

* * * * *

UNITED STATES PATENT AND TRADEMARK OFFICE

CERTIFICATE OF CORRECTION

PATENT NO. : 5,178,265

DATED : January 12, 1993

INVENTOR(S) : Arnold L. Sepke

It is certified that error appears in the above-identified patent and that said Letters Patent is hereby corrected as shown below:

Column 2, line 40, "ont eh" should be --on the--.

Column 12, line 51, "attahed" should be --attached--.

Signed and Sealed this

Second Day of November, 1993

Bruce Lehman

*Attest:*

BRUCE LEHMAN

*Attesting Officer*

*Commissioner of Patents and Trademarks*